United States Patent [19]

Deal

[11] Patent Number: 4,809,718

[45] Date of Patent: Mar. 7, 1989

[54] VARIABLE AIR DILUTION CIGARETTE FILTERS

[75] Inventor: Philip A. Deal, Winston-Salem, N.C.

[73] Assignee: R. J. Reynolds Tobacco Company, Winston-Salem, N.C.

[21] Appl. No.: 46,491

[22] Filed: May 6, 1987

[51] Int. Cl.[4] ..... A24D 3/04

[52] U.S. Cl. ..... 131/336; 131/198.2

[58] Field of Search ..... 131/336, 198.1, 198.2

[56] References Cited

U.S. PATENT DOCUMENTS

| | | | |
|---|---|---|---|
| 2,923,647 | 2/1960 | Aghnides . | |
| 2,936,763 | 5/1960 | Saffir . | |
| 3,359,988 | 12/1967 | Thomson . | |
| 3,503,406 | 3/1970 | Riegel et al. . | |
| 4,406,295 | 9/1983 | Sanford et al. | 131/336 |
| 4,532,943 | 8/1985 | Nichols et al. . | |
| 4,576,187 | 3/1986 | Deal . | |
| 4,649,941 | 3/1987 | Norman et al. . | |
| 4,649,945 | 3/1987 | Norman et al. . | |
| 4,700,725 | 10/1987 | Geiszler | 131/336 |

*Primary Examiner*—V. Millin

[57] ABSTRACT

A variable air dilution cigarette filter is disclosed. The air dilution filter comprises a thin, generally rigid cylindrical sleeve assembly comprising two sleeves frangibly or separably connected together and an overwrapped filter rod received in the sleeves so as to be rotatable with respect to one sleeve and fixed against rotation with respect to the other sleeve. Air dilution openings or perforations are provided in the one sleeve and the underlying filter rod overwrap so that relative rotation between the one sleeve and the filter rod varies the amount of diluting air which is allowed to pass through the sleeve and overwrap and into the filter rod and tobacco smoke.

19 Claims, 5 Drawing Sheets

VARIABLE AIR DILUTION CIGARETTE FILTERS

FIELD OF THE INVENTION

The present invention relates to a cigarette filter and more particularly to a variable air dilution cigarette filter of the type which uses a cylindrical sleeve arranged to overlie a conventional filter rod in rotatable relation thereto.

DESCRIPTION OF THE PRIOR ART

In U.S. Pat. No. 4,576,187 assigned to the assignee of the present invention, the entire disclosure of which is incorporated herein by reference, there is disclosed a variable air dilution cigarette filter comprising a thin, generally rigid cylindrical sleeve or tube in which a conventional filter rod has been partially inserted and over which a perforated or slotted tipping paper has been wrapped. The sleeve is provided with interior annular steps or a helical thread which retain the filter rod within the sleeve and permit relative rotation between the sleeve and filter rod. The sleeve is provided with one or more slots, perforations or other air passages through which diluting air can pass to the filter rod. Variations in the amount of diluting air flow are achieved by relative rotation of the sleeve with respect to the filter rod.

In all embodiments described in U.S. Pat. No. 4,576,187, such relative rotation is accomplished by holding the overwrapped sleeve in the fingers of one hand, grasping the exposed end of the filter rod with the fingers of the other hand and rotating the filter rod and/or sleeve relative to the other to vary the size or area of the air passage and thereby allow selection of a degree of air dilution in accordance with the personal tastes of the user. While the variable air dilution filter disclosed and claimed in U.S. Pat. No. 4,576,187 effectively solves a need in the art for a easily-operated variable air dilution cigarette filter in the manner described therein, limitations in the manner of containing the filter rod within the sleeve and effecting relative rotation between the sleeve and filter rod have created a need for improvements in the filter structure so as to overcome those limitations.

For example, the structure of the variable air dilution cigarette filter of U.S. Pat. No. 4,576,187 results in a stepped diameter filter rod at the draw or mouth end of the cigarette to which the filter is connected. Advantageously, in some embodiments of that invention, the stepped diameter gives an indication of the amount of air dilution which has been set by the smoker. However, even though the illustration of the stepped diameter in the aforesaid prior patent is somewhat exaggerated, some smokers may prefer a constant or uniform diameter at the draw or mouth end of a cigarette despite the advantage the stepped diameter provides. In addition, some smokers may not find it convenient or easy to grasp the exposed tip of the filter rod and rotate it relative to the sleeve because of the relatively short length of the exposed tip of the filter rod.

SUMMARY OF THE INVENTION

In view of the foregoing, it should be apparent that there exists a need in the art for an improved cigarette filter having variable air dilution in which the mechanism for effecting variable air dilution is more easily and conveniently operated. It is therefore a primary objective of the present invention to fulfill that need by providing an improved air dilution cigarette filter with a sleeve of uniform outer diameter having relatively rotatable components for completely containing a filter rod.

More particularly, it is an object of the present invention to provide a variable air dilution cigarette filter in which a filter rod is inserted in and completely contained in a sleeve of uniform outer diameter, the sleeve having means for effecting relative rotation between components of the filter.

Another object of the invention is to provide an improved variable air dilution cigarette filter with relatively rotatable components to effect variations in air dilution and in which relative rotation can be accomplished easily and with a minimum of effort by virtually all users of the cigarette product.

It is a further object of the invention to provide an improved variable air dilution cigarette filter which when attached to a cigarette rod has the outward appearance of uniform diameter from end to end regardless of the amount of air dilution selected by the user.

Yet another object of the invention is to provide an improved sleeve assembly for receiving a filter rod for a variable air dilution cigarette filter in which the sleeve assembly comprises a pair of frangibly connected sleeves which completely contain the filter rod.

Still another object of the invention is to provide a variable air dilution cigarette filter in which rotatable elements of the filter control the amount of air dilution and having means for rotating the elements in an incremental, step-wise manner.

Briefly described, these and other objects of the invention are accomplished according to the invention by providing a thin, cylindrical sleeve assembly constructed at an intermediate portion thereof with frangible connections or otherwise separable into at least a first and second sleeve portion after a filter rod has been inserted into the sleeve assembly so as to be completely contained therein. A first portion of the sleeve is formed either with annular steps or ridges or with a helical thread either of which permits relative rotation between the first sleeve portion and the filter rod contained therein. The first sleeve portion is also provided with one or more slots or perforations in the circumferential wall surface thereof through which dilution air passes to the filter rod. The filter is provided with an air impermeable overwrap which has been slotted, perforated or otherwise provided with an air permeable zone. Relative rotation between the first sleeve portion and the filter rod varies from zero to a maximum the amount of air which is allowed to pass through the slots or perforations of the first sleeve, through the slots, perforations or permeable zone of the filter overwrap and into the filter rod.

The second sleeve portion is formed coaxially with the first sleeve portion and is provided on the interior circumferential surface thereof with longitudinally extending ribs or projections for preventing or limiting relative rotation between the second sleeve portion and the filter rod contained therein. The first and second sleeve portions are separably joined together, preferably frangibly, at the intermediate portion of the sleeve to facilitate assembly of the variable air dilution filter by inserting a filter rod into the two joined sleeve portions.

The first sleeve portion is attached to a tobacco rod by tipping paper with perforations or slots adapted to be aligned with the perforation or slots in the first sleeve portion. The second sleeve is preferably not overwrapped with tipping paper, but is left exposed at the draw end of the cigarette so that it can be rotated relative to the tipping paper-covered first sleeve portion. If the second sleeve portion has not been completely separated from the first sleeve portion during manufacture of the filter, relative rotational movement between the sleeve portions will fracture the frangible connecting portions therebetween and will permit the user to variably rotate the sleeve portions into a desired relative rotational position and thus effect the desired extent of air dilution of the tobacco smoke.

A preferred form of the frangible connection between the first and second sleeve portions comprises minute bridges of material connecting the portions at angularly spaced points. Such bridges may be formed during the manufacture of the sleeve by molding the sleeve of a plastic material. Alternate embodiments of the separable connection between the sleeve portions are described in greater detail hereinafter. The filter rod may extend only a short distance into the second sleeve portion or it may extend up to or just short of the free end of the second sleeve portion depending on the particular embodiment of the frangible connection between the sleeves.

BRIEF DESCRIPTION OF THE DRAWINGS

While the patentable features of the variable air dilution cigarette filter in accordance with the present invention, are set forth with particularity in the appended claims, a full and complete understanding of the invention may be had by referring to the detailed description of preferred embodiments as set forth hereinafter, and as may be seen in the accompanying drawings in which:

DESCRIPTION OF THE PREFERRED EMBODIMENTS

Figure 1:
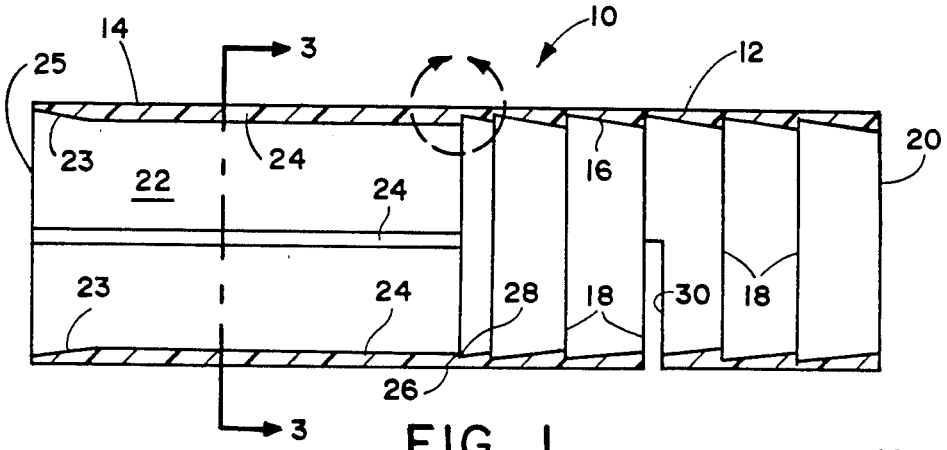
FIG. 1 is a cross-sectional side elevation view of the first preferred embodiment of a sleeve assembly for the variable air dilution cigarette filter in accordance with the present invention.
Figure 2:
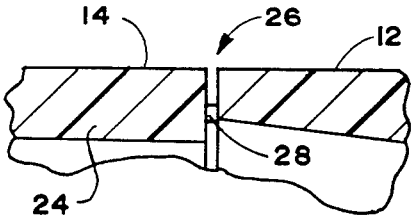
FIG. 2 is an enlarged fragmentary detail of the cross-sectional view of FIG. 1 showing the frangible connection between the portions of the sleeve assembly.
Figure 3:
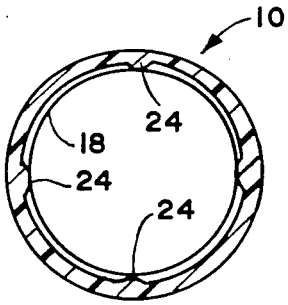
FIG. 3 is a cross-sectional end view of the sleeve assembly taken along line 3—3 of FIG. 1.

Referring now to the drawings, there is illustrated in FIGS. 1–3 a first preferred embodiment of a sleeve assembly 10 for a variable air dilution cigarette filter in accordance with the present invention. Sleeve 10 comprises a thin-walled, rigid or semi-rigid cylindrical tube molded or otherwise fabricated of polyethylene or other suitable plastic material, or paper or other suitable material. The sleeve assembly 10 has a generally smooth outer surface and comprises a first sleeve or first sleeve portion 12 and a second sleeve or second sleeve portion 14 preferably integrally formed or molded in one piece. The interior wall surface 16 of the first sleeve 12 is preformed or premolded with a plurality of annular ridges or steps 18 which slope slightly outwardly from one annular step 18 to the next toward the free end 20 of the first sleeve. As described hereinafter in connection with the second preferred embodiment, the inner surface 16 may also be formed with a helical ridge which functions in the nature of a thread.

The inner cylindrical surface 22 of second sleeve portion 14 is formed with a plurality of optional longitudinal ribs or projections 24 spaced around the sleeve, preferably at equiangularly spaced intervals, e.g., 90° as shown in FIG. 3. Ribs 24 extend from the intermediate portion 26 of the sleeve assembly 10 to the free end 25 of the second sleeve 14 and are preferably tapered adjacent the free end 25 of the second sleeve 14 as shown at reference numeral 23. When ribs 24 are not used, other forms of projections, knurling or other frictional means may be provided on the inner surface of second sleeve portion 14. A sufficient interference fit between the inside diameter of sleeve 14 and the outer diameter of a filter rod inserted therein may also be provided to prevent relative rotation therebetween. Adhesives may also be used.

Second sleeve 14 is separably, and preferably frangibly attached to the first sleeve 12 at an intermediate portion 26 of the sleeve assembly 10 by means of small frangible bridges or tabs 28 of material formed during the molding or fabrication of the sleeve assembly 10. The tabs 28 hold the two sleeves 12 and 14 together during insertion of a filter rod therein, yet are easily fractured or broken when the sleeves 12,14 are rotated in opposite directions or when one sleeve is rotated relative to the other. An air dilution opening means such as a circumferential slot 30 is formed in the wall of first sleeve 12 and extends through a predetermined arc of about 180° or less depending on the volume of air dilution desired to be admitted as will now be described in connection with FIGS. 4–6.

Figure 4:
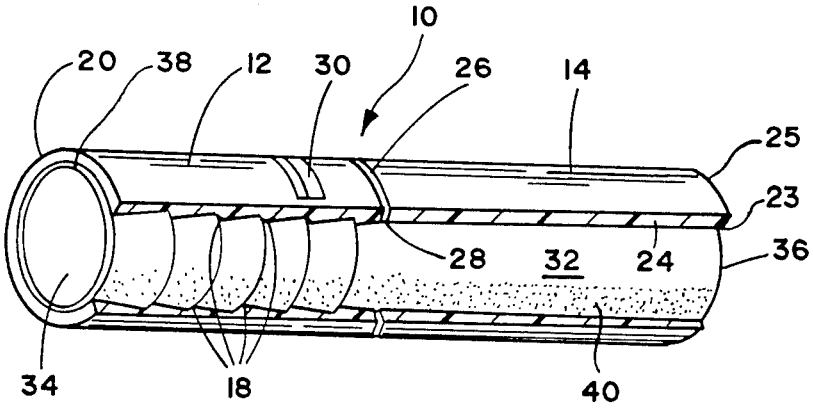
FIG. 4 is a perspective view, partly in cross-section, of the first preferred embodiment of the variable air dilution cigarette filter of the invention illustrating a filter rod inserted in the sleeve assembly.

A generally conventional filter rod 32 is inserted into the sleeve assembly 10 as shown in FIG. 4 until a first end 34 of the filter rod 32 is flush with the free end 20 of the first sleeve 12. The other or second end 36 of filter rod 32 is contained entirely within the second sleeve 14 and may be recessed slightly from the free end 25 of the second sleeve. Filter rod 32 is either wrapped with a conventional filter wrap 38 which is nonpermeable, except for an arcuate zone of permeability or porosity 40 extending longitudinally along the filter rod. The arcuate zone of permeability is generally less than 180° and is generally commensurate with the arcuate extent of the circumferential slot 30 in the first sleeve 12.

The filter rod 32 with its wrap 38 is forced into the sleeve assembly 10 from the free end 25 of the second sleeve 14 so that the end 34 of the rod is accommodated by the tapered portions 23 of the ribs 24 and slides easily past the ribs to the intermediate portion 26 and past the slightly sloped faces of the annular ridges 18 of the first sleeve 12. The rod 32 is sized with a predetermined diameter so that it is compressed slightly as it is forced into the sleeve assembly 10. Once the filter rod 32 has been inserted into the sleeve assembly, the annular ridges 18 function as a retaining means to retain the rod 32 within the sleeve assembly 10 and prevent its easy withdrawal. During manufacture of the variable air dilution cigarette filter of the invention, the first and second sleeves 12,14 may be relatively rotated to break the frangible tabs 28 after insertion of the filter rod 32; however, it is preferable that manufacture of the variable air dilution cigarettes proceed to completion with the frangible tabs 28 intact to avoid dislodgement of the second sleeve 14 from the filter rod and to insure uniformity of the in-process components of the variable air dilution cigarette filter of the invention.

Figure 5:
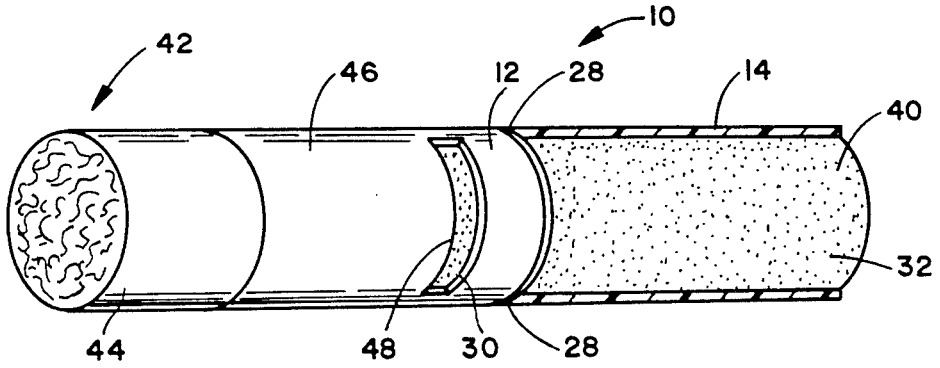
FIG. 5 is a perspective view, partly in cross-section, of the first preferred embodiment of the variable dilution cigarette filter of the invention arranged in the maximum dilution position.
Figure 6:
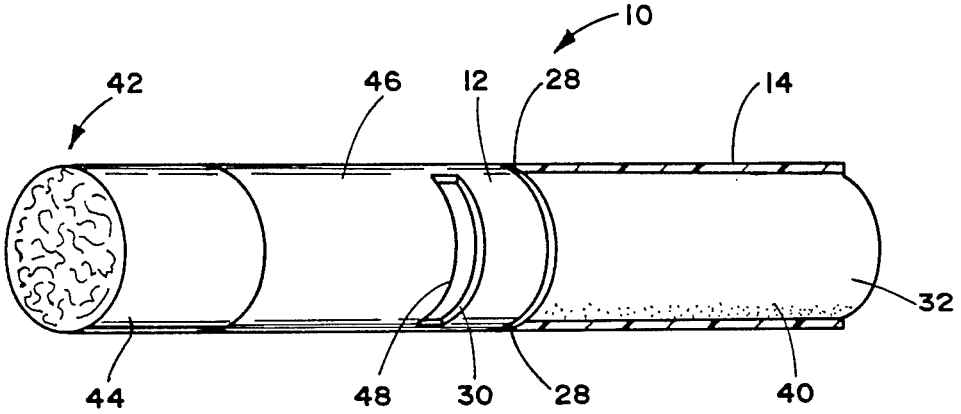
FIG. 6 is a perspective view, partly in cross-section, of the first preferred embodiment of the variable air dilution cigarette filter of the invention arranged in the minimum or zero air dilution position.
Figure 7:
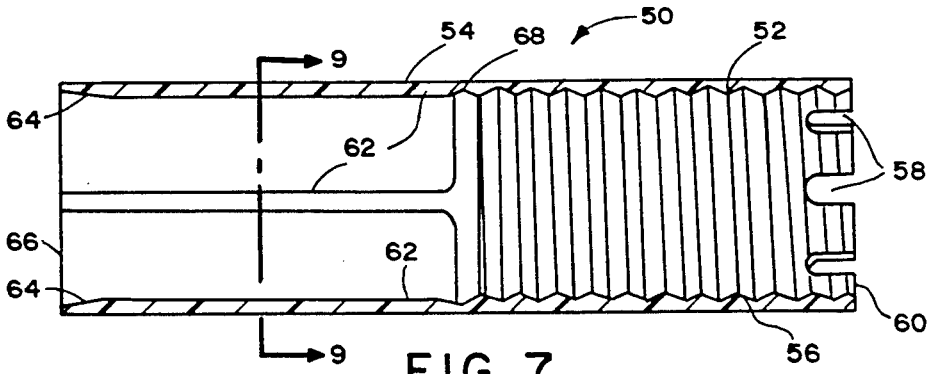
FIG. 7 is a cross-sectional side elevation view of the second preferred embodiment of a separable sleeve assembly for the variable air dilution cigarette filter in accordance with the present invention.

Referring now to FIGS. 5 and 6, a cigarette designated generally with reference numeral 42 is shown connected to the first preferred embodiment of the sleeve assembly 10 to form a variable air dilution cigarette. The cigarette 42 comprises a conventional paper-wrapped tobacco rod 44 positioned in abutting relation with the ends 20,34 of the first sleeve 12 and filter rod 32, respectively. The sleeve assembly 10 and tobacco rod 44 are joined together by an encircling band of tipping paper 46 which is provided with air dilution opening means, such as a slot 48 corresponding in arcuate length with the circumferential slot 30 in the first sleeve 12. Tipping paper 46 may overlie the entire longitudinal extent of the first sleeve 12 or it may extend from a point on the tobacco rod 44 up to the forward edge of the slot 30 in the first sleeve 12 so long as there is a sufficient longitudinal length of tipping paper to securely fasten the tobacco rod 44 to the first sleeve 12. However, tipping paper 46 may extend beyond the first sleeve 12 onto the outer periphery of the second sleeve 14, provided that the second sleeve remains free to be rotated relative to the first sleeve. If it is desired that the tipping paper 46 extend to a point flush with the free end 25 of the second sleeve 14, a circumferential cut should be made in the tipping paper at a location rearwardly of the slot 30,48, for example, at the intermediate portion 26 between the sleeves, to permit the second sleeve to be rotated relative to the first sleeve.

The first sleeve 12, filter rod 32 and tobacco rod 44 are preferably in the positions shown in FIG. 6 with the frangible tabs 28 still intact upon completion of manufacture and packaging of the cigarette 42. In those relative positions, there is no air dilution because the permeable zone 40 of the filter wrap 38 is not aligned with the slots 30,48 in the first sleeve 12 and tipping paper 46. Since the filter wrap 38 is nonpermeable, except for the arcuate permeable zone 40, no diluting air can pass through the slots 30,48 and into the filter rod 32. Thus, for the smoker who desires no air dilution, the cigarette 42 comes from its package in a condition of no air dilution as shown in FIG. 6.

Should air dilution of the smoke from the cigarette be desired, it is only necessary for the smoker to hold the first sleeve 12 and tobacco rod 44 stationary, grasp the second sleeve 14 and rotate it relative to the first sleeve 12 to thereby break the frangible tabs 28. Since the filter rod 32 is nonrotatable with respect to the second sleeve 14 (because of the ribs 24 or other frictional means), but is rotatable with respect to the first sleeve 12, the permeable zone 40 of the filter rod will be rotated relative to the slots 30,48 until it is aligned therewith as shown in FIG. 5. By varying the arcuate extent of the permeable zone 40 that is aligned with the slots 30,48, the amount of air dilution of the smoke can be effectively varied. Thus, a variable air dilution condition is quickly and easily achieved merely by rotation of the second sleeve 14 to break the frangible tabs 28 and rotatably position the second sleeve 14 in a desired and adjustable angular orientation relative to the first sleeve 12.

A second preferred embodiment of a thin, generally cylindrical sleeve assembly 50 for a variable air dilution cigarette filter is illustrated in FIGS. 7–10 and comprises a first sleeve portion 52 and a second sleeve portion 54. Sleeve assembly 50 is generally similar to sleeve assembly 10, except that the internal surface of the first sleeve portion 52 is provided with a shallow helical thread 56, and, instead of a circumferential slot for admitting diluting air, the first sleeve portion 52 is provided with a plurality of circumferentially spaced, longitudinally extending slots 58 formed at the free end 60 thereof. The pitch of the helical threads or steps 56 is preferably such that one complete 360° revolution of the first sleeve 52 relative to a filter rod contained therein will move the second sleeve 54 and the internal filter rod an axial distance relative to the first sleeve 52 equal to the longitudinal length of the slots 58. The above-described arrangement for admitting dilution air to the filter rod of the second preferred embodiment herein corresponds to that of the first preferred embodiment of the invention described in the aforementioned U.S. Pat. No. 4,576,187 and shown therein in FIGS. 1–5 and thus need not be described further herein.

The second sleeve portion 54 of sleeve assembly 50 is provided with optional longitudinal ribs 62 similar to ribs 24 of the first embodiment. Ribs 62 are similarly tapered as shown at reference numeral 64 to facilitate insertion therein of a filter rod covered with an air impermeable overwrap (not shown). As in the first embodiment, other frictional means between the sleeve portion 54 and a filter rod inserted therein may be used.

Figure 8:
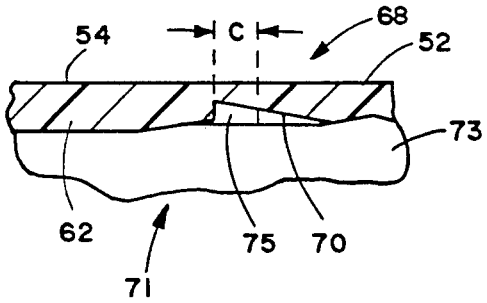
FIG. 8 is an enlarged fragmentary detail of the sleeve assembly of FIG. 7 showing the separable connection between the portions of the sleeve assembly with a filter rod inserted therein.
Figure 9:
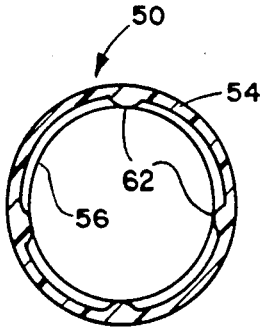
FIG. 9 is a cross-sectional end view of the sleeve assembly of FIG. 7 taken along line 9—9.

The sleeve assembly 50 is provided with an intermediate portion 68 between the first and second sleeve portions 52,54 which is shown in an enlarged view in FIG. 8. The intermediate portion includes a thin, tapered wall portion 70 interconnecting the internally threaded first sleeve 52 with the ribbed second sleeve 54 for a purpose to be hereinafter described.

A generally conventional filter rod is slightly compressed and inserted into sleeve assembly 50 with one end thereof flush with free end 60 of the first sleeve 52 and the other end flush or slightly recessed from free end 66 of the second sleeve 54. In FIG. 8, a filter rod 71 with an air impermeable overwrap 73 is shown after it has been inserted in the sleeve assembly. A small annular air space 75 surrounds the overwrap 73 in the region of the tapered wall portion 70 for a purpose to be described.

The first and second sleeves are separated at the intermediate portion 68 by any suitable cutting or machining operation. For example, a circumferential saw cut may be made in the portion 68 to remove an annular section of the sleeve material in zone C (FIG. 8). Since care must be taken not to cut or otherwise penetrate the air impermeable overwrap 73 of the filter rod 71, the air space 75 provided between the overwrap 73 and the tapered wall portion 70 permits the intermediate portion 68 to be cut through with a minimum depth of cut of the saw and without danger of damaging the overwrap.

Figure 10:
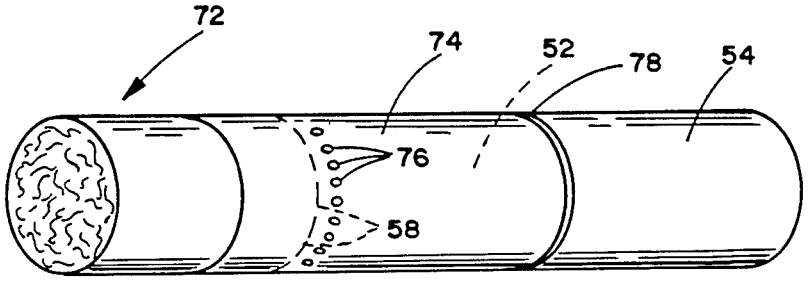
FIG. 10 is a perspective view of the second preferred embodiment of the variable air dilution cigarette filter of the invention arranged in the minimum or zero air dilution position.
Figure 11:
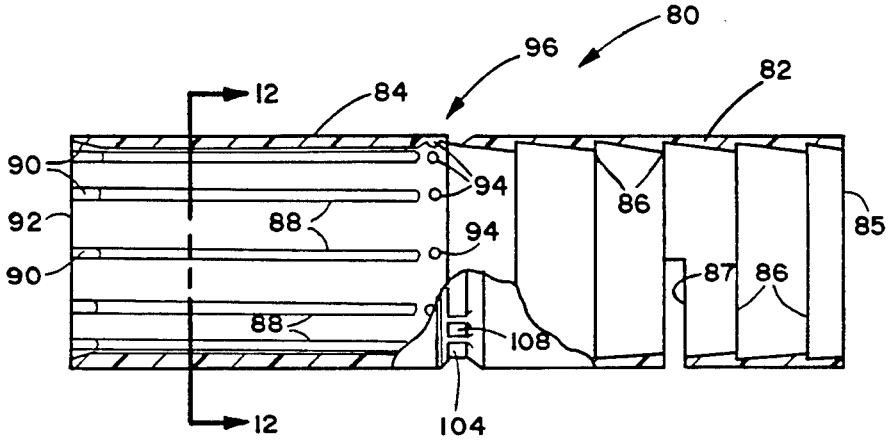
FIG. 11 is a cross-sectional side elevation view of the third preferred embodiment of a sleeve assembly for the variable air dilution cigarette filter in accordance with the present invention.
Figure 12:
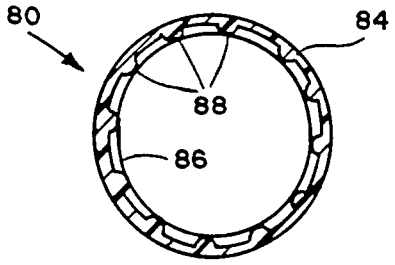
FIG. 12 is a cross-sectional end view of the sleeve assembly of FIG. 11 taken along line 12—12.

Referring now to FIG. 10, after separation of the first and second sleeves 52,54 the sleeve assembly 50 and filter rod are joined to a conventional paperwrapped tobacco rod 72 with a suitable encircling band of tipping paper 74 having circumferential perforations 76 aligned longitudinally with the underlying longitudinal slots 58 in the first sleeve 52. In the position shown in FIG. 10, the ends of the filter and tobacco rods abut and the impermeable filter rod overwrap prevents any diluting air from entering the end of the filter rod abutting the tobacco rod. Thus, a zero or minimum air dilution condition is achieved and, preferably, the cigarette is packaged in this condition.

To admit diluting air into the filter rod, the first and second sleeves 52,54 are rotated relative to one another by turning the second sleeve 54 and effectively unthreading the filter rod from the helical threads of the first sleeve 52 through an arc from 0° to 360° to create a chamber of increasing axial length between the abutting ends of the tobacco rod and filter rod thus increasing the amount of dilution air. As the second sleeve 54 is rotated, the space or gap 78 between the confronting ends of the first and second sleeves will also increase from a minimum to a maximum and thereby provide the smoker with an external, visual indication of the amount of dilution air being admitted into the filter.

A third preferrd embodiment of a thin, generally cylindrical sleeve assembly 80 for a variable air dilution cigarette filter is illustrated in FIGS. 11–15 and comprises a first sleeve portion 82 and a second sleeve portion 84 preferably molded in one piece of a plastic material. Sleeve assembly 80 is generally similar to sleeve assembly 10 of the first preferred embodiment. Inwardly of the free end 85 of the first sleeve 82 there is formed a plurality of optional annular ridges or steps 86 and a circumferential slot 87 of 180° or less which function in the same manner as ridges 18 and slot 30 of the first preferred embodiment.

Second sleeve portion 84 is provided on its interior surface with a plurality of optional longitudinal ribs 88, each having a tapered portion 90 at the free end 92 of the second sleeve 84, such ribs 88 having the same function as ribs 24 of the second sleeve 14 of the first preferred embodiment. When ribs 88 and ridges 86 are not used, the inner diameter of each sleeve is selected relative to the filter outside diameter for appropriate frictional gripping with respect to sleeve 84 or tolerance for slipping with respect to sleeve 82. Of course, as in the first embodiment, alternative means may be used to affix the filter rod in non-rotatable relation to the second sleeve, including other forms of projections, knurling or adhesives.

Adjacent the innermost end of each longitudinal rib 88 is a slightly raised projection 94 having a generally hemispherical surface molded onto the circumferential inner surface of the second sleeve 84. The first and second sleeves are molded together at an intermediate portion 96 with a frangible connection which is fractured by axial movement of the two sleeves toward one another in a manner and for a purpose to be hereinafter described in connection with FIGS. 13–15.

Figure 13:
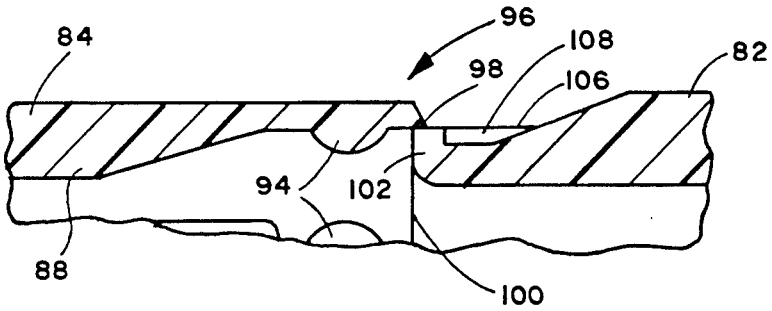
FIG. 13 is an enlarged fragmentary detail of the cross-sectional view of FIG. 11 showing the frangible connection between the portions of the sleeve assembly prior to rupture thereof.
Figure 14:
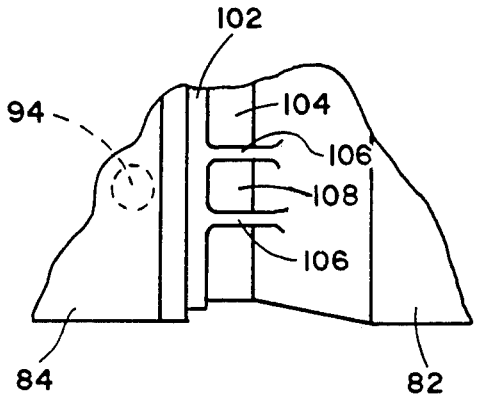
FIG. 14 is an enlarged fragmentary detail in side elevation of the connection between the portions of the sleeve assembly of FIG. 11 prior to rupture of the frangible connection therebetween.

Now referring to FIGS. 13 and 14, the first and second sleeves 82,84 are molded such that they are connected together along an annular attachment zone 98 of minimum axial extent. The innermost end 100 of the first sleeve 82 has an outwardly directed annular containment edge or lip 102 and an annular trough 104. As best shown in FIG. 14, the annular trough 104 is provided in at least one arcuate position with a pair of upstanding ribs 106 forming a shallow recess 108 therebetween.

Figure 15:
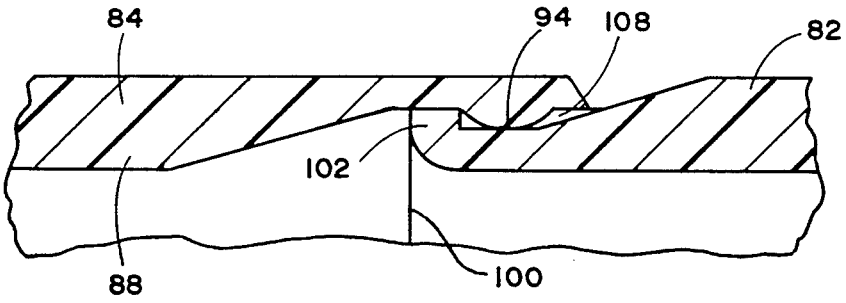
FIG. 15 is an enlarged fragmentary detail of the frangible connection of FIG. 13 after rupture of the frangible connecting elements.

Prior to insertion of a filter rod with an arcuate, air permeable zone into the free end 92 of the second sleeve in the manner described in connection with the first embodiment, the first and second sleeves are forced toward one another by applying oppositely directed forces to the free ends 85,92 of the sleeves until the small annular attachment zone 98 ruptures and the containment lip 102 is urged inwardly to ride over the projections 94 and into the axial position shown in FIG. 15 to restrict axial separation of the sleeves, yet permit relative rotation thereof. If desired, this rupturing step may advantageously be performed simultaneously with insertion of a filter rod into the sleeve assembly 80.

Referring to FIG. 14, it will be seen that one of the projections 94 is longitudinally aligned with the shallow recess 108 formed between the two ribs 106 in the annular trough 104. When the connection 98 is ruptured and lip 102 moves axially into the position shown in FIG. 15, the aligned projection 94 will seat in the recess 108 and locate the first and second sleeves 82,84 in a predetermined rotational position with respect to one another. Relative rotation of the first and second sleeves with sufficient angular force will cause the projection 94 to ride up over one or the other of the ribs 106 so that the projections are freely circumferentially movable in the trough 104 until one of the ribs 106 engages and rides over the next adjacent projection 94 to locate such adjacent projection in the recess 108 in another predetermined angular position. In that manner, rotation between the sleeves can be accomplished in an incremental, step-wise manner through an entire 360° of relative rotation. In the embodiment of FIGS. 11–15, there are twelve equiangularly spaced projections 94 resulting in twelve equal 30° increments of relative rotational movement. Other incremental angular steps are, of course, possible and within the contemplation of the present invention.

After insertion of the filter rod, the sleeve assembly 80 is joined to a tobacco rod in the same manner as described above in connection with FIGS. 5 and 6 using a filter rod with an arcuate, air permeable zone. If, for example, the air permeable zone of the filter rod is 180° and the slot 87 in the first sleeve portion 82 is also 180°, the air dilution filter can be step-wise adjusted from zero to maximum air dilution in six increments or steps of 30°. Such incremental adjustment provides better accuracy or control of air dilution and assures the secure relative rotational orientation of the first and second sleeves during the entire period of time the cigarette is smoked.

The preferred embodiments of the variable air dilution cigarette filter in accordance with the present invention all utilize a slotted, thin, generally rigid cylindrical tube or sleeve assembly which has separable first and second sleeve portions, the first one of which is rotatable with respect to a filter rod to effect variable air dilution and the second one of which is rotationally fixed to the filter rod to provide a means for conveniently rotating the filter rod relative to the first sleeve. The variable air dilution cigarette filter in accordance with the invention is simple, inexpensive and is capable of being manufactured and applied to tobacco and filter rods using currently available cigarette-making machinery. The invention satisfies a need by providing a single, disposable cigarette filter assembly which can be used by smokers who want no air dilution and smokers who want a high degree of air dilution. The large number of smokers whose tastes lie between those extremes will be satisfied by the filter assembly of the present invention, particularly where it is desired to change the amount of air dilution incrementally.

While the preferred embodiments of the variable air dilution cigarette filter of the present invention have been fully and completely set forth hereinabove, it will be apparent to those skilled in the art that many changes in, for example, the material used for the sleeve, the types of filter rod and tipping paper and the like, may be made without departing from the true spirit and intended scope of the invention which is, accordingly, limited only by the following claims.

What is claimed is:

1. A variable air dilution cigarette filter assembly for attachment to a tobacco rod to form a variable air dilution cigarette, said filter assembly comprising:

a first thin, generally rigid cylindrical sleeve having at least one air opening passing through a circumferential wall of said first sleeve;

a filter rod positioned within said first sleeve;

means within said first sleeve, including a plurality of radially inwardly-extending steps on the inner wall of said first sleeve, for permitting rotation between said first sleeve and said rod;

a second thin, generally rigid cylindrical sleeve fitted over said filter rod in longitudinal alignment with said first sleeve and detachably joined thereto;

antirotational means on the inner wall of said second sleeve for restricting relative rotary motion between said filter rod and said second sleeve; and means for varying dilution air flow through said air opening to said filter rod in response to relative rotation of said first sleeve and said second sleeve.

2. The variable air dilution cigarette filter of claim 1 wherein said first and second sleeves are detachably joined by means for frangibly connecting said sleeves together, said steps comprising a plurality of annular ridges.

3. The variable air dilution cigarette filter of claim 1 wherein said ridges comprise a helical thread on said inner wall of said sleeve.

4. The variable air dilution cigarette filter of claim 3 wherein relative rotation of said first sleeve and said second sleeve to effect longitudinal movement between said first sleeve and said filter rod causes a change in the amount of said diluting air passing through said opening to said filter rod.

5. The variable air dilution cigarette filter of claim 4 wherein said air opening is a slot extending longitudinally along said first sleeve from a first end thereof remote from said second sleeve.

6. The variable air dilution cigarette filter of claim 5 wherein said first end of said first sleeve is joined to said tobacco rod and said relative rotation of said first sleeve and said second sleeve to increase dilution air flow moves said slot out of overlying relation with said filter rod and forms a chamber between the juncture of said tobacco rod and said first sleeve.

7. The variable air dilution cigarette filter of claim 6 wherein maximum air dilution is afforded when a plurality of said slots in said first sleeve completely overlie said chamber.

8. The variable air dilution cigarette filter of claim 7 wherein relative rotation of said first sleeve and said second sleeve through about 360° effects longitudinal movement of said filter rod away from said first end of said first sleeve a distance equal to the length of said slots.

9. A variable air dilution cigarette filter assembly for attachment to a tobacco rod to form a variable air dilution cigarette, said filter assembly comprising:

a sleeve assembly comprising first and second cylindrical sleeves arranged in coaxial relation and adapted to be rotated relative to one another;

a filter rod disposed within said sleeve assembly and extending into both of said first and second sleeves, said filter rod being rotatable relative to one of said sleeves;

means arranged between the other of said sleeves and the filter rod for restricting rotational movement between said other sleeve and the filter rod;

air opening means in the wall of one of said sleeves for admitting dilution air;

means for varying the dilution air flow through said air opening means to said filter rod in response to relative rotation between the first and second sleeves; and a plurality of annular ridges arranged on the inner circumferential surface of the first sleeve, said rotation restricting means comprising a plurality of longitudinal ribs on the inner circumferential surface of the second sleeve.

10. A variable air dilution cigarette filter assembly for attachment to a tobacco rod to form a variable air dilution cigarette, said filter assembly comprising:

a sleeve assembly comprising first and second cylindrical sleeves arranged in coaxial relation and adapted to be rotated relative to one another;

a filter rod disposed within said sleeve assembly and extending into both of said first and second sleeves, said filter rod being rotatable relative to one of said sleeves;

means arranged between the other of said sleeves and the filter rod for restricting rotational movement between said other sleeve and the filter rod;

air opening means in the wall of one of said sleeves for admitting dilution air;

means for varying the dilution air flow through said air opening means to said filter rod in response to relative rotation between the first and second sleeves; and means for incrementally rotating the first and second sleeves relative to one another, said incremental rotating means comprising a plurality of angularly spaced projections on the inner surface of one of said sleeves and a complementary recess on the other of said sleeves.

11. The variable air dilution cigarette filter assembly of claim 10, wherein said rotation restricting means comprises a plurality of longitudinal ribs on the inner circumferential surface of the second sleeve, said plurality of projections being longitudinally aligned with said plurality of longitudinal ribs.

12. A variable air dilution cigarette filter assembly for attachment to a tobacco rod to form a variable air dilution cigarette, said filter assembly comprising:

a sleeve assembly comprising first and second cylindrical sleeves arranged in coaxial relation and adapted to be rotated relative to one another, a helical thread on the inner wall of said first sleeve;

a filter rod disposed within said sleeve assembly and extending into both of said first and second sleeves, said first sleeve of said filter rod being rotatable relative to said first sleeve;

means arranged between said second sleeve and the filter rod for restricting rotational movement between said second sleeve and the filter rod;

air opening means in the wall of one of said sleeves for admitting dilution air; and means for varying the dilution air flow through said air opening means to said filter rod in response to relative rotation between the first and second sleeves.

13. A variable air dilution filter for attachment to a smokable article comprising:

a sleeve assembly comprising first and second sleeves arranged in coaxial relation and adapted to be rotated relative to one another;

a filter element extending into said first and second sleeves, one of said sleeves being rotatable relative to the filter element in said one sleeve;

means cooperating between the other of said sleeves and the filter element for restricting rotational movement between said other sleeve and the filter element therein;

air opening means in one of said sleeves for admitting dilution air; and means for varying the dilution air flow through said air opening means to said filter element in response to relative rotation between said first and second sleeves.

14. The variable air dilution filter of claim 13 wherein said filter element has an overwrap, said means for varying the dilution air flow including an air permeable zone in said filter overwrap.

15. The variable air dilution filter of claim 13 wherein said sleeve assembly is made of a rigid or semi-rigid plastic material.

16. The variable air dilution filter of claim 15 wherein said plastic material is polyethylene.

17. The variable air dilution filter of claim 13 wherein the portions of the filter element extending into said first and second sleeves are non-rotatable relative to one another.

18. The variable air dilution filter of claim 13 including frangible means for frangibly connecting the first and second sleeve such that said first and second sleeves are rotationally fixed relative to each other until said frangible connecting means is broken to thereby permit relative rotation between said sleeves.

19. The variable air dilution filter of claim 13 wherein said means for restricting rotational movement between said other sleeve and the filter element portion therein comprises one of the group of a plurality of longitudinal ribs on the inner surface of said other sleeve, adhesive between said other sleeve and the filter element portion, an interference fit between said other sleeve and the filter element portion, knurling on the inner surface or said other sleeve, and projections on the inner surface of said other sleeve.

* * * * *